US006626731B2

(12) United States Patent
Marine

(10) Patent No.: US 6,626,731 B2
(45) Date of Patent: Sep. 30, 2003

(54) CABLE AND ROTOR/LINKAGE ACTUATION SYSTEM FOR ANIMATED TOY MECHANIZED MOVABLE LIMB

(75) Inventor: Jon C. Marine, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 71 days.

(21) Appl. No.: 09/855,397

(22) Filed: May 14, 2001

(65) Prior Publication Data

US 2002/0168918 A1 Nov. 14, 2002

(51) Int. Cl.[7] ..... A63H 3/20; A63H 3/46; A63H 3/36

(52) U.S. Cl. ..... 446/330; 446/376; 446/390

(58) Field of Search ..... 446/330, 335, 446/337, 352, 353, 354, 355, 356, 368, 376, 377, 383, 384, 390

(56) References Cited

U.S. PATENT DOCUMENTS

| | | | | |
|---|---|---|---|---|
| 3,298,130 A | | 1/1967 | Ryan | |
| 3,583,093 A | | 6/1971 | Glass et al. | |
| 3,650,065 A | | 3/1972 | Johmann | |
| 3,672,096 A | | 6/1972 | Johmann | |
| 3,684,291 A | * | 8/1972 | Johmann | 273/145 A |
| 3,846,934 A | | 11/1974 | Thorn et al. | |
| 3,912,694 A | | 10/1975 | Chiappe et al. | |
| 4,023,254 A | | 5/1977 | Aiple et al. | |
| 4,073,088 A | | 2/1978 | Beny et al. | |
| 4,177,602 A | | 12/1979 | Choi | |
| 4,312,150 A | * | 1/1982 | Terzian | 446/354 |
| 4,349,987 A | | 9/1982 | Bart | |
| 4,516,951 A | | 5/1985 | Saigo et al. | |
| 4,563,163 A | | 1/1986 | Herbstler et al. | |
| 4,665,640 A | | 5/1987 | Forsse et al. | |
| 4,681,993 A | | 7/1987 | Kondo et al. | |
| 4,752,272 A | | 6/1988 | Karasawa | |

(List continued on next page.)

FOREIGN PATENT DOCUMENTS

| | | |
|---|---|---|
| JP | 60241110 A | 11/1985 |
| JP | 2065887 A | 3/1990 |
| JP | 3258282 A | 11/1991 |
| JP | 5253866 A | 10/1993 |
| WO | WO 01/49383 A1 | 7/2001 |

OTHER PUBLICATIONS

Herbert Herkiner, ed., *Engineers' Illustrated Thesaurus,* W. M. Pem Publishing, 1952, pp. 172–173.

Selected pages from a book entitled "Machine Devices and Instrumentation", *Kinematics of Intermittent Mechanisms 1—The External Geneva Wheel and Kinematics of Intermittent Mechanisms II—The Internal Geneva Wheel,* Copyright 1966.

Selected pages, Geneva 1 and Geneva 2, from book entitled "Mechanism Linkages and Mechanical Controls" author Nicholas Chironis, (c) 1965.

Selected pages, Geneva 3, 4, 5,6 ,7 and 8, from book entitled "Mechanisms and Mechanical Devices 2$^{nd}$ Edition", authors Nicholas Chironis, Neil Sclater, (c) 1996,1991.

*Primary Examiner*—Derris H. Banks
*Assistant Examiner*—Faye Francis
(74) *Attorney, Agent, or Firm*—Kolisch Hartwell, P.C.

(57) ABSTRACT

A toy doll with articulated moveable wrist/hand structure. A motor in the doll operates to pull on a cable which is drivingly linked to the wrist/hand structure through rotors and links that cooperate, along with regions in the wrist/hand structure to effect complex/compound rotational, translational, and revolutional motions in the wrist/hand structure. The rotors, links and regions mentioned form a pair of interactive pantograph-like arrangements that enhance the produced motions by introducing mechanical advantage.

9 Claims, 3 Drawing Sheets

U.S. PATENT DOCUMENTS 4,764,141 A 8/1988 D'Andrade
4,775,352 A 10/1988 Curran et al.
4,819,229 A 4/1989 Pritty et al.
4,878,870 A 11/1989 Pastor
5,030,161 A 7/1991 Pastor
5,045,015 A * 9/1991 Arad et al. ..... 446/355
5,092,102 A 3/1992 James et al.
5,125,865 A 6/1992 Orenstein et al.
5,139,827 A * 8/1992 Faigel ..... 40/414
5,158,492 A 10/1992 Rudell et al.
5,224,896 A 7/1993 Terzian
5,236,385 A 8/1993 May
5,290,185 A * 3/1994 Murakami ..... 446/330
5,310,377 A 5/1994 Joja
5,316,516 A 5/1994 Saitoh
5,374,216 A * 12/1994 Jung et al. ..... 446/175
5,394,766 A 3/1995 Johnson et al.
5,405,142 A 4/1995 Arad et al.
5,505,652 A 4/1996 Click
5,603,177 A * 2/1997 Saunders ..... 40/411
5,647,787 A 7/1997 Raviv et al.
5,747,760 A 5/1998 Skarivoda
5,820,441 A 10/1998 Pracas
5,941,756 A 8/1999 Chou

* cited by examiner

CABLE AND ROTOR/LINKAGE ACTUATION SYSTEM FOR ANIMATED TOY MECHANIZED MOVABLE LIMB

BACKGROUND OF THE INVENTION

This invention pertains to toy doll structure of the animated variety, and in particular, to cable/rotor/linkage structure for moving one or more articulated limbs in such a doll under the influence of an appropriate, on-board drive motor. Especially, the present invention features a unique cable/rotor/leverage mechanism which offers improved mechanical-advantage performance (for example, improved cable performance) in comparison with conventional driving connections that exist between such articulated limbs and such a drive motor. A preferred embodiment of the present invention is described herein in conjunction with moving articulated components present in the wrist/hand structure in a toy doll.

According to the preferred embodiment of the invention, operatively interposed a drive motor (of the kind generally mentioned) and the particular selected articulated wrist/hand components are an elongate cable, and an arrangement of drivingly interconnected rotors and pivoted links, which cooperate during motor-driven pulling and tensing of the cable to effect the desired articulation motion. Such motion, as will be seen, includes a blend of complex and compound translation, rotation and revolution. The end of the cable which is remote from the drive motor is trained in a kind of serpentine fashion around a common-axis, combined pulley gear, whereby tensioning and pulling motion of the cable causes rotation of this pulley/gear. The gear portion in this rotary twosome (pulley/gear) is drivingly interconnected with one or more additional rotary elements, and therethrough to plural linkage structure that is operatively and drivingly connected to the wrist/hand structure. This linkage structure (which herein also economically includes certain portions of rotor structure, and also selected regions in the wrist/hand structure) uniquely includes a pair of mechanical-advantage-enhancing, pantograph-type arrangements that contribute to the operational effectiveness of the invention.

The overall structure is quite simple in construction, and leads to a final doll structure wherein, for example, wrist/hand motion control is producable in very effective, efficient and realistic manners.

These and various other features and advantages that are offered by the present invention will become more fully apparent as the description which now follows is read in conjunction with the accompanying drawings.

DETAILED DESCRIPTION OF, AND BEST MODE FOR CARRYING OUT, THE INVENTION

Figure 1:
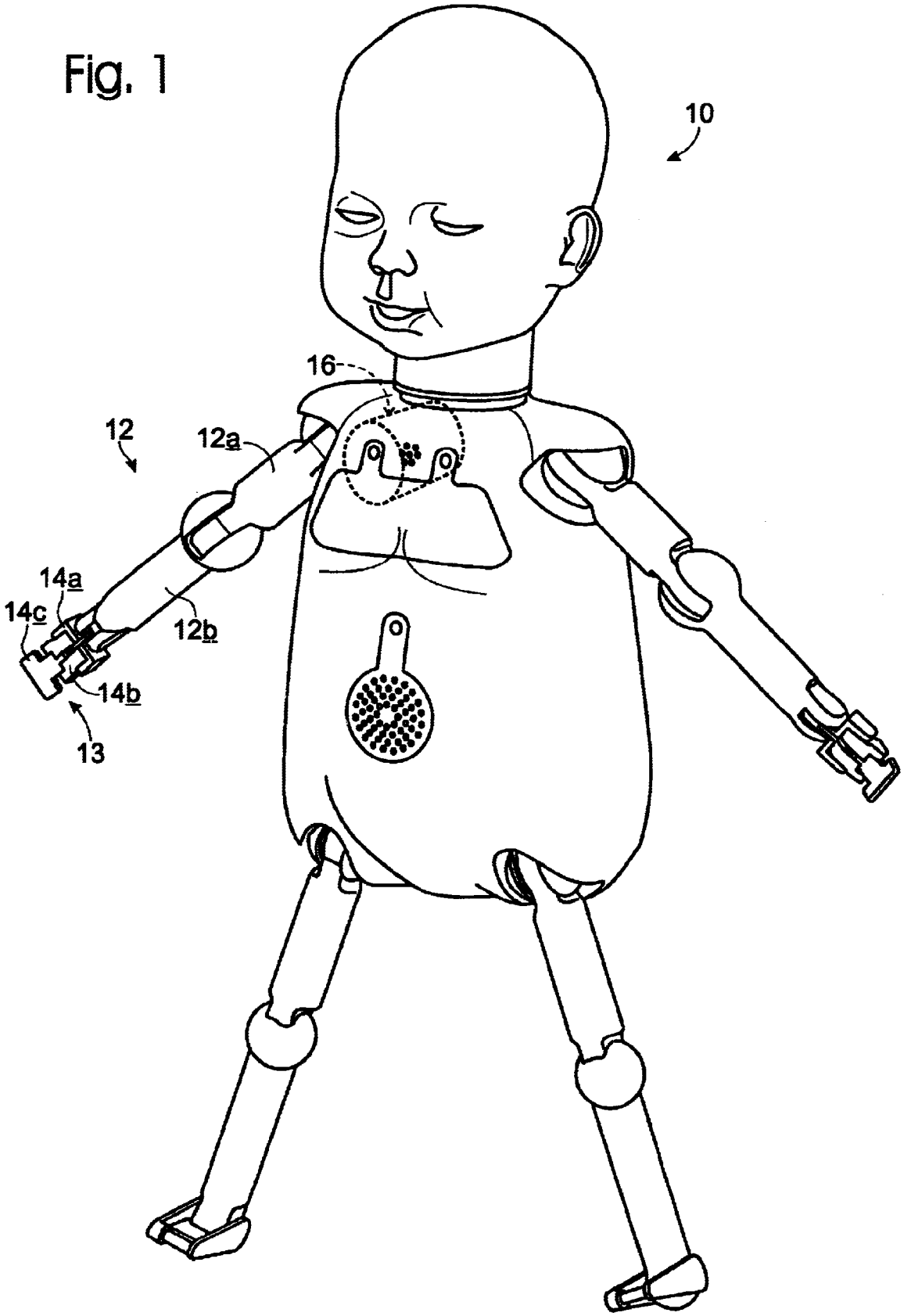
FIG. 1 is a frontal, perspective, view illustrating an animated toy doll, and more specifically, generally the skeletal structure of such a doll, which includes wrist/hand structure that is moved by motion/drive structure constructed in accordance with the present invention.

Turning attention now to the drawings, and referring first of all to FIG. 1, indicated generally at 10 is the skeletal structure an animated toy doll. Doll 10 includes elongate arm structure, such as right arm 12, having upper and lower elongate arm components 12*a*, 12*b*, respectively. Carried near the lower end of arm component 12*b* is wrist/hand structure 14, also referred to herein as articulated appendage/limb structure. Also, suitably provided in arm 12, within arm component 12*b*, is motion/drive structure (not specifically shown in FIG. 1) that has been constructed in accordance with the present invention for producing certain kinds of motion in the wrist/hand structure. It should be understood that while the invention is described herein especially in conjunction with effecting and promoting articulation motion in wrist/hand structure 14, the invention could also be used to move other kinds of limbs and appendages, if so desired, in a toy doll like that pictured in FIG. 1.

Wrist/hand structure 14 herein includes an articulated wrist component 14*a* which is appropriately pivoted near the lower end of lower arm component 12*b*, an upper articulated hand component 14*b* which is pivotally joined to component 14*a* in a manner that will shortly be more fully described, and a lower hand component 14*c* which is pivotally attached to component 14*b*. Wrist/hand components 14*a*, 14*b*, 14*c* are also referred to herein as substructures.

Focusing attention now on FIGS. 2–8, inclusive, along with FIG. 1, suitably mounted within the central body structure of doll 10 is an electric drive motor 16 which is employable, via operation of the structure of the present invention, to produce articulation motion in wrist/hand components 14*a*, 14*b*, 14*c*. The exact location of motor 16 is not critical to an understanding of the present invention, and for the purpose of the present description of this invention, motor 16 is deemed to be within the central body structure of doll 10 generally near the region where upper arm portion 12*a* joins with the body-trunk portion in the doll. This drive motor is represented only schematically, and only in FIGS. 1 and 2.

Forming interactive components in the overall structure of a preferred embodiment of the present invention (the motion/drive structure), which embodiment is shown generally and variously at 18 in FIGS. 2–8, inclusive, are an elongate cable 20, and rotor and linkage structure generally pointed to by arrow 22 in the drawings.

Figure 2:
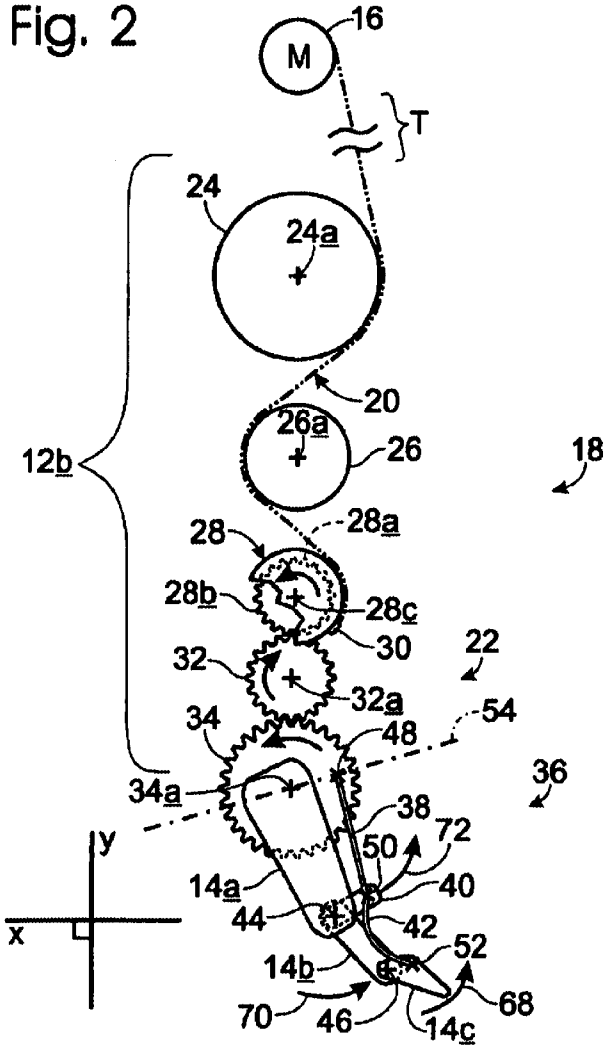
FIG. 2 is an enlarged, fragmentary and schematic view illustrating such motion/drive.
Figure 4:
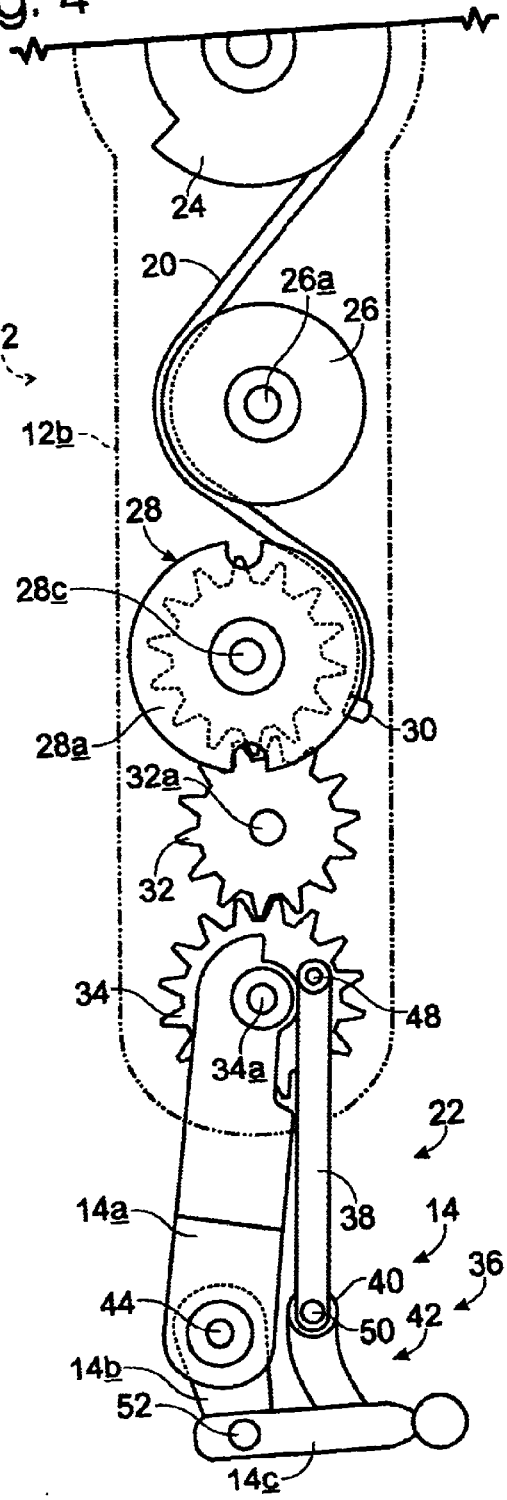
FIG. 4 is an enlarged, fragmentary and schematic view of an embodiment of the motion/drive of FIG. 2.
Figure 5:
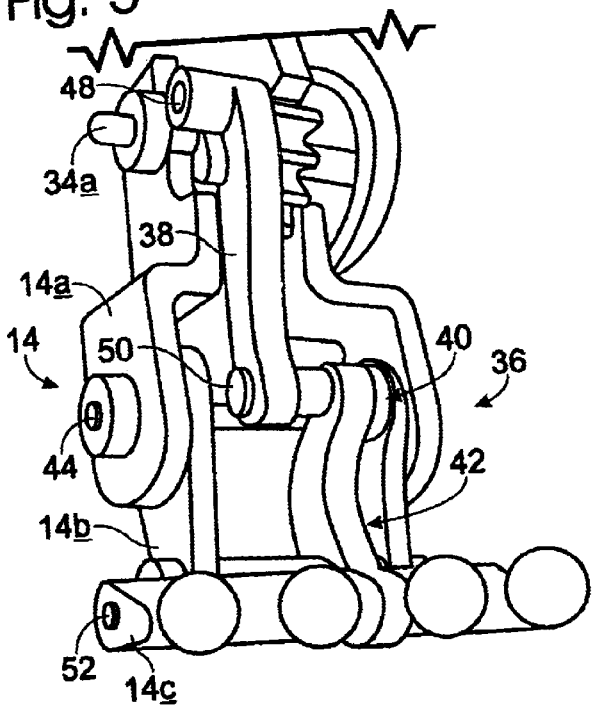
FIG. 5 is an enlarged isometric view of the lower end of the motion/drive of FIG. 2.

As can be seen particularly in FIG. 2, cable 20 extends from motor 16 downwardly in the figure in a somewhat serpentine fashion (within lower arm structure 12*b*) around a pair of a journalled idlers 24, 26. From there, the cable extends downwardly and partially around a combined pulley/gear 28. In particular, the lower end, or extremity, of cable 20 extends partially around a pulley portion 28*a* in pulley/gear 28, and is anchored thereto as shown at 30 in FIG. 2. Idlers 24, 26 are suitably journalled within lower arm structure 12*b* for turning freely about substantially parallel axes 24*a*, 26*a*, respectively. Pulley/gear 28 is likewise journalled for rotation about an axis 28*c* which generally parallels axes 24*a*, 26*a*.

The teeth in a gear portion 28*b* in pulley/gear 28 drivingly mesh with teeth in another gear 32, which other gear has teeth that mesh drivingly with teeth in still another gear 34. Pulley portion 28*a* is also referred to herein as a pulley structure, and gear portion 28*b* as a first driven gear. Gears 32, 34 are similarly journalled for rotation within lower arm structure 12*b* about axes 32*a*, 34*a*, respectively. These two axes substantially parallel previously-mentioned axes 24*a*, 26*a*, 28*c*. Pulley/gear 28, along with gears 32, 34, may be referred to herein individually or collectively as rotor structure.

Shown generally at 36 in several different ones of the drawing figures is the linkage structure portion of previously-mentioned rotor and linkage structure 32. Included in linkage structure 36 are portions of previously mentioned wrist/hand components 14*a*, 14*b*, 14*c*, and in addition, elongate links 38, 40, 42. In FIG. 2, links 38, 42 have simply been shown (for simplification purposes) as single solid lines, with the line that represents link 42 having generally the upwardly and rightwardly facing concave curvature illustrated. The reason for this curvature will be explained shortly. It should also be noted that, within FIGS. 2 and 3, the exact relative positions of the various components pictured there, as well as the exact relative sizes and perimetral outlines of various components, are not necessarily to scale or exact. These aspects of configuration, placement and sizing are, for the most part, simply matters of appropriate choice, and, except to any extent pointed out below, do not specifically form any part of the present invention.

Component 14*a* is suitably pivoted for swinging on axis 34*a*. Component 14*b* is appropriately pivoted relative to component 14*a* for rotation about an axis 44. Component 14*c* is similarly pivoted to component 14*b* for rotation relative thereto about an axis 46.

Figure 3:
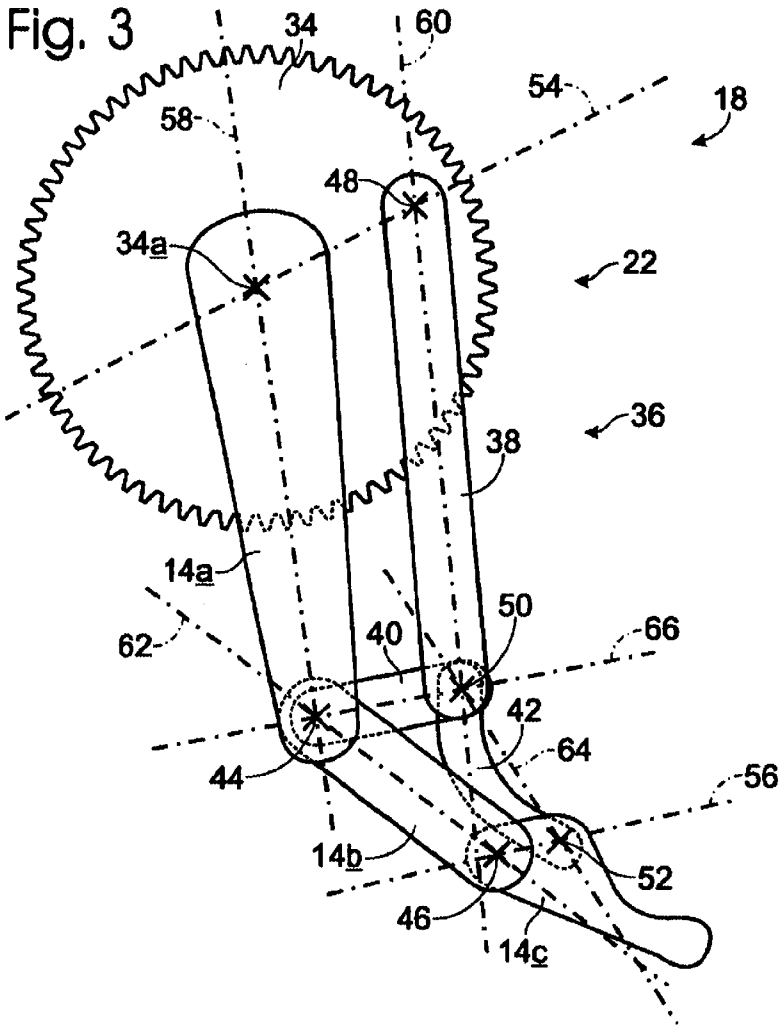
FIG. 3 is a further enlarged fragmentary schematic detail focusing on components that are present according to the invention near the lower portion of FIG. 2.

Link 38 has its upper end in FIGS. 2 and 3 pivoted to gear 34 appropriately for rotation relative to the gear about an axis 48. The lower end of link 38 is suitably pivoted to the right end of link 40 in FIGS. 2 and 3 for rotation about an axis 50. The left end of link 40 in FIGS. 2 and 3 is pivoted for rotation appropriately about previously-mentioned axis 44. Link 42, the curved link, has its upper end in FIGS. 2 and 3 pivoted to link 40 for rotation relative to this link about axis 50. The lower end of link 42 in these two figures is pivoted to component 14*c* for rotation relative thereto about an axis 52. Component 14*a* and link 38 are moveable (pivotally) relative to gear 34.

Link 42 has the rightwardly/upwardly facing concave curvature pictured in FIGS. 2 and 3 in order to allow, in the final presentation and completion of doll 10, the insides of the palms in the doll's hands to possess a fairly normal cup shape.

Still discussing linkage structure 36, further operationally included in this linkage structure are regions both in gear 34 and in component 14*c*. These regions coact with other components in the linkage structure to form what can be thought of herein as two articulation-motion pantograph-like arrangements. Very specifically, the region in gear 34 which so functions is that region which lies along dash-dot line 54 in FIGS. 2 and 3, and which extends between axes 34*a*, 48. The region within component 14*c* which forms part of the linkage structure herein is that portion which lies along dash-dot line 56 (see particularly FIG. 3), and which extends between axes 46, 52. Several other dash-dot lines that are presented in FIGS. 2 and 3 are helpful in visualizing what has been referred to above as pantograph-like arrangements. These additional dash-dot lines include lines 58, 60, 62, 64 and 66. One of the pantograph-like arrangements referred to herein is described by the region bounded by lines 54, 58, 60, 66. The other such region is the one bounded by lines 56, 62, 64, 66. With the pantograph-like regions structured as shown (i.e., in relation to the relative lengths of the respective, bounding dash-dot lines), pulling of cable 20 delivers mechanical-advantage motions to the wrist/hand components. Such mechanical-advantage behavior can be recognized by the fact that a given amount of translational movement in cable 20 effects less motion in the wrist/hand components than would be the case were the rotor and linkage structure of this invention not employed—for example, in a situation where such a cable was directly connected, say, just to a component like component 14*c*.

Describing now how the structure of the present invention performs in the setting of doll 10, the nominal (or unmoved) initial relative positions of the components in the wrist/hand structure might be very much like those positions generally shown in FIGS. 1, 2 and 3. Maintenance of the various articulated components in this nominal state might typically be under the influence of a passive biasing spring, or a collection of such springs (not shown in any view herein). This "normal positioning" consideration forms no part of the present invention.

When it is desired to cause articulation motion in the wrist/hand structure herein, motor 16 is operated to pull upon and tension cable 20, thus to draw the same generally upwardly as such is pictured in FIG. 2. Tensioning of the cable is indicated near the top of FIG. 2 by the letter T. With cable 20 trained as shown in the generally serpentine fashion around idlers 24, 26, and around the pulley portion of pulley/gear 28, these rotary components rotate about axes 24*a*, 26*a*, 28*c* in a counterclockwise, clockwise and counterclockwise manners, respectively. These respective directions of rotation are pictured by curved arrows drawn on the respective rotary elements in FIG. 2. Such rotational motion is transmitted by gear portion 28*b* to gears 32, 34 and this causes gear 32 to rotate about axis 32 in a clockwise direction in FIG. 2, and gear 34 to rotate in a counterclockwise direction around axis 34*a*. These rotational directions are pictured on gears 32, 34 by curved arrows in FIG. 2.

With such rotation taking place in gear 34, combined rotational, translational, and revolutional motions take place, in different patterns, within components 14*a*, 14*b*, 14*c* and links 38, 40, 42, with the two pantograph-like arrangements generally changing geometric shapes to accommodate these motions. This action causes the wrist/hand components to move, and curl inwardly, quite realistically, with compound motions occurring therein that include one or more of translation, rotation and revolution.

Specifically, component 14*c* rotates relative to component 14*b* in a counterclockwise direction about axis 46. This rotation is indicated by arrow 68 in FIG. 2. Component 14*b* rotates relative to component 14*a*, also in a counterclockwise direction, and about axis 44, as indicated by arrow 70 in FIG. 2. Component 14*a* also rotates in a counterclockwise direction in FIG. 2, and about axis 34*a* relative to gear 34. This motion is indicated in FIG. 2 by curved arrow 72.

What can be seen, therefore, is that tensional translation introduced into cable 20 by motor 16 causes rotational motion of wrist/hand component 14*a* relative to the lower arm portion 12*b*. Component 14*b* undergoes a more complex motion, and specifically (a) motion which includes rotation about axis 44, (b) translation (in an X/Y) sense in the plane of FIG. 2, and (c) revolution relative to axis 34*a*. Directions of translational motion, that is orthogonal directions of such motion, are illustrated by the crossed lines that appear at the lower left side of FIG. 2. Wrist/hand component 14*c* undergoes an even more complex, compound motion, including (a) rotation about axis 46, (b) translation and revolution relative to axis 44, and (c) translation and revolution also relative to axis 34*a*.

Thus, one can see that the proposed mechanism of the present invention offers a very simple structure for utilizing longitudinal single cable movement to create very complex and quite naturally looking motions in appendages in a toy doll, such as in the wrist/hand structure in doll 10 specifically discussed hereinabove and illustrated.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

I claim:

1. An articulated doll, comprising:

a doll body;

a rotor operatively connected to the body;

a first component extending outwardly from the body;

a first link pivotally connected to the rotor;

a second link pivotally interconnected between the first component and the first link;

a second component pivotally connected to the first component and the second link;

a third link pivotally connected to the first link and the second link; and a third component pivotally connected to both the second component and the third link.

2. The doll of claim 1, wherein the rotor and the first component rotate about a single rotor axis, and the first link rotates about a distant axis.

3. The doll of claim 1, wherein the first link is rigid.

4. The doll of claim 3, wherein the third link is rigid.

5. The doll of claim 1, wherein the third link is rigid.

6. The doll of claim 5, wherein the third link is curved.

7. The doll of claim 1, wherein the rotor is a gear.

8. The doll of claim 1, further comprising an arm structure, wherein the first link, the third link, the first component, the second component, and the third component define a wrist and hand structure at an end of the arm structure.

9. The doll of claim 8, wherein the rotor is operatively driven by a cable, thereby causing the wrist and hand structure to clasp or unclasp.

* * * * *